US005546601A

United States Patent [19]

Abeyta

[11] Patent Number: 5,546,601

[45] Date of Patent: Aug. 20, 1996

[54] NECK AND CERVICAL SPINE PROTECTOR DEVICE FOR DISPERSING AXIAL COMPRESSIVE FORCES

[76] Inventor: Alan Abeyta, 244 Vaquero Dr., Boulder, Colo. 80303

[21] Appl. No.: 395,871

[22] Filed: Feb. 23, 1995

[51] Int. Cl.[6] ..... A41D 13/00

[52] U.S. Cl. ..... 2/2; 2/425

[58] Field of Search ..... 2/2, 410, 411, 2/421, 425, 44, 45, 424, 422; 602/17, 18, 19

[56] References Cited

U.S. PATENT DOCUMENTS

| | | | |
|---|---|---|---|
| 3,189,917 | 6/1965 | Sims | 2/415 |
| 3,514,784 | 6/1970 | McDavid | 2/2 |
| 3,522,804 | 8/1970 | Towbin | 128/133 |
| 3,591,863 | 7/1971 | Rickard | 2/415 |
| 4,094,015 | 6/1978 | Howard | 2/415 |
| 4,219,193 | 8/1980 | Newman | 272/94 |
| 4,274,161 | 6/1981 | Littler | 2/413 |
| 4,319,362 | 3/1982 | Ettinger | 2/415 |
| 4,338,685 | 7/1982 | LaPorta, Jr. | 2/2 |
| 4,562,833 | 1/1986 | Pujals, Jr. | 602/18 |
| 4,821,339 | 4/1989 | Fair | 2/2 |
| 4,881,529 | 11/1989 | Santos | 602/18 |
| 4,996,720 | 3/1991 | Fair | 2/2 |
| 5,123,408 | 6/1992 | Gaines | 602/18 |
| 5,287,562 | 2/1994 | Rush, III | 2/413 |
| 5,404,590 | 4/1995 | Monica, Jr. | 2/2 |

*Primary Examiner*—C. D. Crowder
*Assistant Examiner*—Larry P. Worrell, Jr.
*Attorney, Agent, or Firm*—John R. Flanagan

[57] ABSTRACT

A neck and cervical spine protector device for the dispersement of axial compressive forces on the head away from the neck and cervical spine region to the posterior midline portions of the shoulders and upper thoracic region of the user includes a U-shaped upper structure for fitting about the back and opposite sides of the neck of the user and resting upon the posterior midline portions of the shoulders of the user adjacent to the opposite sides of the neck, a top surface defined on the U-shaped upper structure for seating thereon a head protector worn by the user, and a lower structure, connected to and extending downwardly from a lower portion of the U-shaped upper structure, to overlie the upper thoracic region on opposite sides of the spinal column for dispersing axial compressive forces applied on the head away from the neck and spine directly to a greater area on the shoulders and upper thoracic region of the user's body or indirectly thereto in conjunction with shoulder protectors worn by the user.

20 Claims, 1 Drawing Sheet

NECK AND CERVICAL SPINE PROTECTOR DEVICE FOR DISPERSING AXIAL COMPRESSIVE FORCES

BACKGROUND OF THE INVENTION

1. Field of the Invention

The present invention generally relates to a neck and cervical spine protector and, more particularly, is concerned with a protector device that disperses axial compressive forces on the head away from the neck and cervical spine region to the shoulders and upper thoracic region of the user's body.

2. Description of the Prior Art

Participation in competitive contact sports such as football and in other activities like riding motorcycles where a helmet is used by the participant creates many opportunities for injuries to the neck and spine of the participant's body. The cervical spine, which serves to protect spinal neural tissues and connects the head to the rest of the body, is especially susceptible to injury from axial compressive loads placed upon it. Such loads occur when force is applied to the top, back or crown of the head in a direction toward a person's body. These axial compressive forces, when excessive as in sports or other activities, may cause a person's vertebrae to loose its structural integrity. This loss of structural integrity, in the cervical spine, is highly dangerous and may cause neural dysfunction as severe as quadriplegia or death.

Axial loading has been established as a major cause of spinal injuries as the cervical spine and surrounding soft tissues are especially vulnerable to dynamic injury. Injuries involving hyper-extension and hyper-flexion whiplash may also cause damage to the cervical spine and surrounding tissue and possibly neural tissue due to its mechanism of injury inclusive of compressive forces. Damage to the cervical spine may cause neural dysfunction such as quadriplegia or death.

Many devices have been developed over the years to address the prevention of injuries to the neck and spine of a person's body. Some of these devices are not for use in contact sports but are specifically tailored for neck trauma therapy or to prevent whiplash-type injuries resulting from sudden movements of the neck. The most common feature of these devices is a brace or pad at or near the neck. Representative examples of such devices are disclosed in U.S. Pat. No. 3,522,804 to Towbin and U.S. Pat. No. 4,562,833 to Pujals, Jr.

Other devices are specifically tailored to prevent whiplash-type and compressive injuries to the neck and spine during a person's participation in contact sports such as football or in other activities such as riding motorcycles where a helmet is worn by the participant. Many of these devices utilize braces or pads similar to those devices disclosed in the above mentioned prior art. Representative examples of these devices are disclosed in U.S. Pat. No. 3,189,917 to Sims, U.S. Pat. No. 3,591,863 to Rickard, U.S. Pat. No. 4,094,015 to Howard, U.S. Pat. No. 4,219,193 to Newman, U.S. Pat. No. 4,274,161 to Littler, U.S. Pat. No. 4,319,362 to Ettinger, U.S. Pat. No. 4,881,529 to Santos, U.S. Pat. No. 5,123,408 to Gaines and U.S. Pat. No. 5,287,562 to Rush, III.

A major problem with these devices, however, is that they fail to effectively disperse compressive forces from the head region to other parts of the body. For example, the Gaines patent discloses a device extensively aimed at providing support for the deterrence of axial compressive fractures in the cervical spine region with a flexible support brace assembly that has a shoulder brace portion with right and left shoulder members which overlie the shoulders on opposite sides of the neck and extend down the back on opposite sides of the cervical spine to where they connect to shoulder pads worn by a football player. The right and left shoulder members are connected by a cross bar which, in turn, is connected to the player's helmet by a neck brace member. The problem with this device, however, is that it relies upon a single narrow brace to resist and disperse compressive forces from the helmet to the shoulders and therefore requires too much redirection of the impact forces before transmission to and dispersion over a greater area can take place.

Consequently, a need still exists for an effective means for the dispersion of axial compressive forces on the head away from the neck and spine to other parts of the body for use in contact sports such as football and in other activities such as riding motorcycles where a helmet is worn by the participant.

SUMMARY OF THE INVENTION

The present invention provides a neck and cervical spine protector designed to satisfy the aforementioned need. The principal advantage of the present invention is that the device disperses axial compressive forces on the head away from the neck and cervical spine region to the posterior midline portions of the shoulders and upper thoracic region of the user's body.

Accordingly, the present invention is directed to a neck and cervical spine protector device which disperses axial compressive forces. The device comprises: (a) a U-shaped upper structure for fitting about the back and opposite sides of the neck of the user and resting upon portions of the shoulders of the user adjacent to the opposite sides of the neck, (b) means defined in the U-shaped upper structure for seating thereon a head protector worn by the user, and (c) a lower structure, connected to and extending downwardly from a lower portion of the U-shaped upper structure, to overlie the upper thoracic region on opposite sides of the spinal column for dispersing axial compressive forces applied on the head away from the neck and spine to a greater area on the posterior midline portions of the shoulders and upper thoracic region of the user's body.

More particularly, the U-shaped upper structure has a substrate body adapted to fit about the back and sides of the neck of a user and to overlie and rest upon the portions of the shoulders of the user adjacent to the opposite sides of the neck. The substrate body has a superior outer surface defined thereon having an arcuate cross-section and extending about a superior outer edge thereof to provide a seat for a lower edge of a head protector worn by the user. The superior outer surface can have a shape tailored to fit the contours of the particular head protector to be worn by a user. The substrate body also has an interior arcuate wall defining a recess extending about an inner edge thereof to provide clearance of the user's head.

The protector device also includes a layer of padding attached to the interior surface of the substrate body of the upper structure and to an interior side of lower structure for user comfort. The lower structure, connected to and extending downwardly from a lower portion of the U-shaped upper structure, has an upper portion with an exterior side and an interior side merging in a rearward and downward arcuate direction with the exterior side such that the interior side substantially conforms with the shape of the shoulders and upper thoracic region of the user, adapting the lower structure to rest thereon. The lower structure also has a lower bifurcated portion defining a pair of legs having spaced inner edges defining a slot extending upwardly therebetween from a lower edge of the lower structure such that the inner edges of the legs are aligned on opposite sides of the spinal column of the user so that the legs overlie the upper thoracic region on opposite sides of the spinal column of the user's body.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
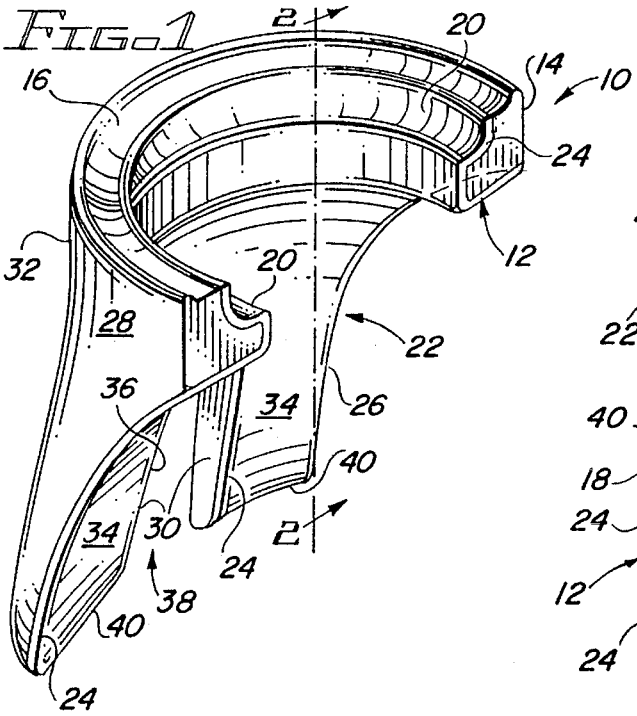
FIG. 1 is a perspective view of the neck and cervical spine protector device of the present invention.
Figure 2:
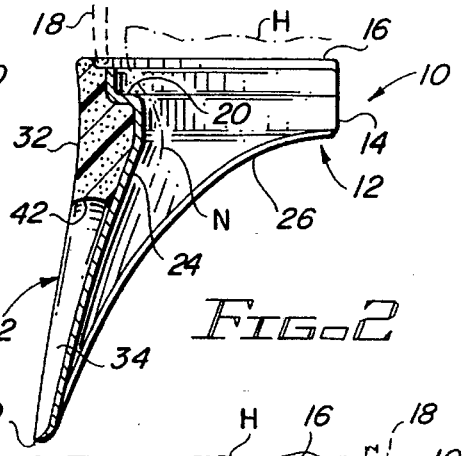
FIG. 2 is a longitudinal sectional view of the neck and cervical spine protector device taken along line 2—2 of FIG. 1.
Figure 3:
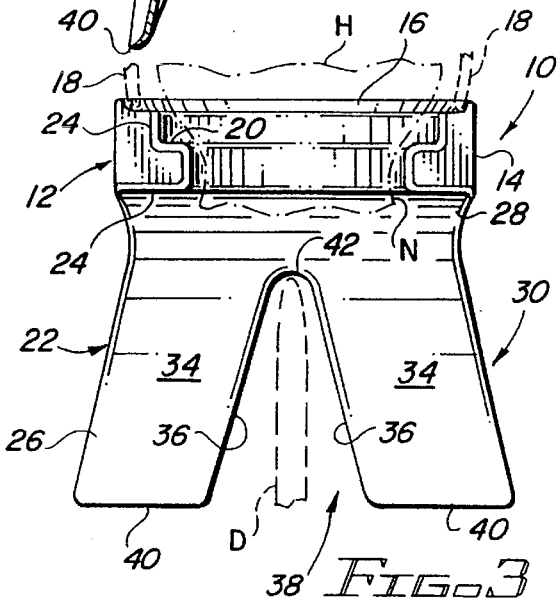
FIG. 3 is a front elevational view of the neck and cervical spine protector device.

Referring to the drawings and particularly to FIGS. 1 to 3 and 5, there is illustrated a neck and cervical spine protector device, generally designated 10, of the present invention, for the dispersion of axial compressive forces on the head H away from the neck N and cervical spine region C to posterior midline portions of the shoulders S and upper thoracic region of a user B.

The protector device 10 includes a U-shaped upper structure 12 in the form of a substrate body 14 being arcuate shaped and forming a substantially half circle for fitting about the back and opposite sides of the neck N of the user B and resting upon the posterior midline portions of the shoulders S of the user B adjacent to the opposite sides of the neck N. The substrate body 14 has a superior outer surface 16 defined thereon having an arcuate cross-sectional shape substantially concave and extending about a superior outer edge thereof to provide a seat for a lower edge of a head protector 18 worn by the user B. The superior outer surface 16 will have a shape tailored to fit the respective contour of the particular head protector 18 to be worn by a user. The substrate body 14 also has an interior arcuate wall 20 defining a recess extending about an inner edge thereof to provide clearance of the user's head H.

The protector device 10 also includes a lower structure 22, connected to and extending downwardly from a lower portion of U-shaped upper structure 12, to overlie the upper thoracic region on opposite sides of the spinal column D for dispersing axial compressive forces imparted on the head H away from the neck N and spine to a greater area on the posterior midline portions of the shoulders S and upper thoracic region of the user B.

Referring now to FIGS. 1 to 5, the substrate body 14 of the U-shaped upper structure 12 is adapted to fit about the back and opposite sides of the neck N of the user B overlying and resting upon the posterior midline portions of the shoulders S of the user B adjacent to the opposite sides of the neck N. The arcuate superior surface 16 on the outer edge of the upper structure 12 seats the lower edge of the head protector 18. For the user's comfort, the protector device 10 also includes a layer of padding 24 attached to the interior arcuate wall 20 of substrate body 14 and an interior side 26 of the lower structure 22.

The lower structure 22 of the protector device 10, connected to and extending downwardly from the lower portion of the U-shaped upper structure 12, has an upper portion 28 and a lower bifurcated portion 30. The upper and lower portions 28, 30 of the lower structure 22 have an exterior side 32 in addition to the interior side 26 which merges in a rearward and downward arcuate direction toward the exterior side 32 such that the interior side 26 substantially conforms with the shape of the posterior midline portions of the shoulders S and upper thoracic region of the user B, adapting the lower structure 22 to rest thereon. The lower bifurcated portion 30 defines a pair of legs 34 having spaced apart inner edges 36 defining a slot 38 extending upwardly therebetween from a lower edge 40 of lower structure 22 such that the inner edges 36 of legs 34 are aligned along opposite sides of the spinal column D of the user B so that the legs 34 overlie the upper thoracic region on opposite sides of the spinal column D of the user B.

The pair of legs 34 of lower bifurcated portion 30 each have relatively the same length and width and extend away from one another in a divergent rearward and downward fashion. The inner edges 36 of the legs 34 of lower bifurcated portion 30 extend toward one another in a convergent forward and upward fashion to an arcuate bight 42 located closer to the U-shaped upper structure 12 than to lower edge 40 of lower structure 22. The spaced inner edges 36 of the legs 34 forming the wedge-shaped slot 38 keep the device 10 from touching the spinal column D of the user B and enable the device 10 to disperse axial compressive forces and whiplash hyper-extension and hyper-flexion forces applied on the head H to the posterior midline portions of the shoulders S and upper thoracic region of the body of the user B.

Figure 5:
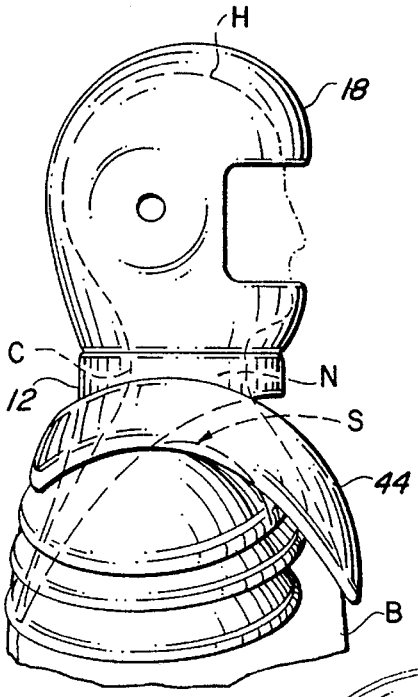
FIG. 5 is a rear elevational view of the neck and cervical spine protector device in combination with the head and shoulder protectors.
Figure 4:
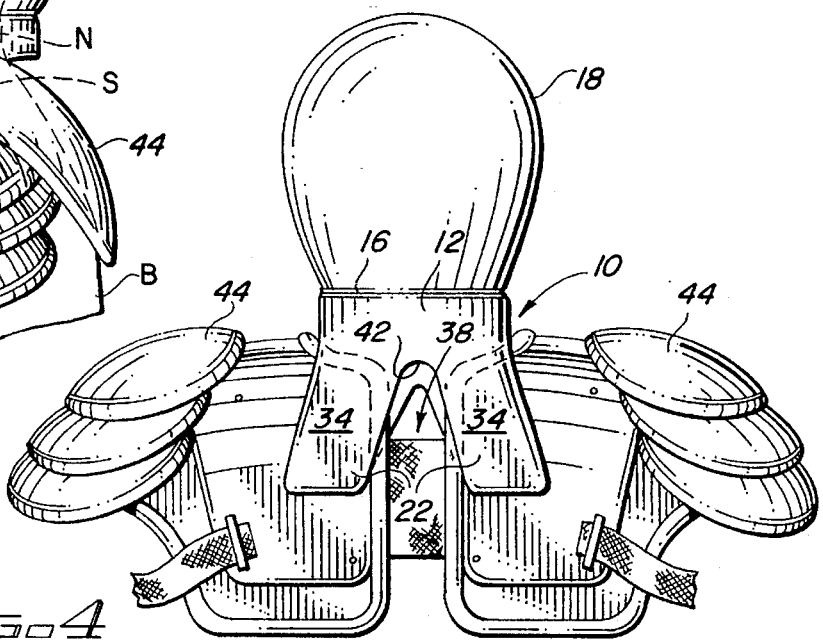
FIG. 4 is a side elevational view of the neck and cervical spine protector device in combination with head and shoulder protectors.

Finally, both upper and lower structures 12 and 22 are composed of a material being markedly more rigid than the material composing the layer of padding 24 attached to the interior arcuate wall 20 of the upper structure 12 and interior side 26 of the lower structure 22. As seen in FIGS. 4 and 5, the protector device 10 is adapted to be placed on the user's shoulders S or mounted on shoulder protectors or shoulder pads 44. The device 10 can be provided separate from or attached to the shoulder pads 44.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A neck and cervical spine protector device, comprising:

(a) a U-shaped upper structure for fitting about the back and opposite sides of the neck of a user and resting upon posterior midline portions of the shoulders of the user adjacent to the opposite sides of the neck;

(b) means defined in said U-shaped upper structure for seating thereon a head protector worn by the user, said means for seating the head protector being a superior surface defined on said upper structure having an arcuate substantially concave cross-sectional shape and extending about a superior outer edge of said upper structure; and (c) a lower structure, connected to and extending downwardly from a lower portion of said U-shaped upper structure, to overlie the upper thoracic region on opposite sides of the spinal column of the user for dispersing axial compressive forces applied on the head away from the neck and spine to the posterior midline portions of the shoulders and upper thoracic region of the user.

2. The device of claim 1 further comprising:

a layer of padding attached to said interior wall of said upper structure.

3. The device of claim 2 wherein said upper and lower structures are composed of a material being markedly more rigid than a material composing said layer of padding.

4. A neck and cervical spine protector device, comprising:

(a) a U-shaped upper structure for fitting about the back and opposite sides of the neck of a user and resting upon posterior midline portions of the shoulders of the user adjacent to the opposite sides of the neck;

(b) means defined in said U-shaped upper structure for seating thereon a head protector worn by the user;

(c) a lower structure, connected to and extending downwardly from a lower portion of said U-shaped upper structure, to overlie the upper thoracic region on opposite sides of the spinal column of the user for dispersing axial compressive forces applied on the head away from the neck and spine to the posterior midline portions of the shoulders and upper thoracic region of the user, said lower structure having an upper portion with an exterior side and an interior side extending in a rearward and downward arcuate direction merging toward said exterior side such that said interior side substantially conforms with the shape of the posterior midline portions of the shoulders and upper thoracic region of the user; and (d) a layer of padding attached to said interior wall of said upper structure and also attached to and extending down said interior side of said upper portion of said lower structure.

5. The device of claim 4 wherein said lower structure has a lower bifurcated portion defining a pair of legs having spaced inner edges defining a slot extending upwardly therebetween from a lower edge of said lower structure such that said inner edges of said legs are aligned on opposite sides of the spinal column of the user so that said legs overlie the upper thoracic region on opposite sides of the spinal column of the user.

6. The device of claim 5 wherein said pair of legs of said lower bifurcated portion extend away from one another in a divergent rearward and downward fashion.

7. The device of claim 5 wherein said inner edges of said legs defining said slot of said lower bifurcated portion extend toward one another in a convergent forward and upward fashion to an arcuate bight disposed closer to said U-shaped upper structure than to said lower edge of said lower structure.

8. A neck and cervical spine protector device, comprising:

(a) a U-shaped upper structure having a substrate body adapted to fit about the back and opposite sides of the neck of a user and to overlie and rest upon the posterior midline portions of the shoulders of the user adjacent to the opposite sides of the neck, said substrate body having a superior surface defined thereon having an arcuate cross-section and extending about a superior outer edge thereof to provide a seat for a lower edge of a head protector worn by the user, said substrate body also having an interior arcuate wall defining a recess extending about an inner edge thereof to provide clearance of the user's head;

(b) a lower structure, connected to and extending downwardly from a lower portion of said U-shaped upper structure, said lower structure having (i) an upper portion having an exterior side and an interior side extending downwardly from said lower portion of said upper structure, said interior side merging in a rearward and downward arcuate direction toward said exterior side so as to conform with the shape of the posterior midline portions of the shoulders and upper thoracic region of the user, adapting said lower structure to rest thereon, and (ii) a lower bifurcated portion defining a pair of legs having spaced inner edges defining a slot extending upwardly therebetween from a lower edge of said lower structure such that said inner edges of said legs are aligned on opposite sides of the spinal column of the user so that said legs overlie the upper thoracic region on opposite sides of the spinal column of the user; and (c) a layer of padding attached to said interior arcuate wall of said substrate body of said upper structure and said interior side of said lower structure.

9. The device of claim 8 wherein said pair of legs of said lower bifurcated portion extend away from one another in a divergent rearward and downward fashion.

10. The device of claim 8 wherein said inner edges of said legs defining said slot of said lower bifurcated portion extend toward one another in a convergent forward and upward fashion to an arcuate bight disposed closer to said U-shaped upper structure than to said lower edge of said lower structure.

11. The device of claim 8 wherein said substrate body of said upper structure and said lower structure are composed of a material being markedly more rigid than a material composing said layer of padding.

12. A neck and cervical spine protector system, comprising:

(a) a head protector; and (b) a neck and cervical spine protector device having (i) a U-shaped upper structure for fitting about the back and opposite sides of the neck of the user and resting upon the portions of the shoulders of the user adjacent to the opposite sides of the neck, said upper structure having an interior arcuate wall defining a recess extending about an inner edge of said upper structure to provide clearance of the user's head, (ii) means defined in said U-shaped upper structure for seating thereon a head protector worn by the user, said means for seating the head protector being a superior surface defined on said upper structure having an arcuate substantially concave cross-sectional shape extending about a superior outer edge of said upper structure, and (iii) a lower structure, connected to and extending downwardly from a lower portion of said U-shaped upper structure, to overlie the upper thoracic region on opposite sides of the spinal column for dispersing axial compressive forces applied on the head away from the neck and spine to the shoulders and upper thoracic region of the user.

13. The system of claim 12 further comprising:

a layer of padding attached to said interior arcuate wall of said upper structure.

14. The system of claim 13 wherein said upper and lower structures are composed of a material being markedly more rigid than a material composing said layer of padding.

15. A neck and cervical spine protector system, comprising:

(a) a head protector; and (b) a neck and cervical spine protector device having (i) a U-shaped upper structure for fitting about the back and opposite sides of the neck of the user and resting upon the portions of the shoulders of the user adjacent to the opposite sides of the neck, said upper structure having an interior arcuate wall defining a recess extending about an inner edge of said upper structure to provide clearance of the user's head, (ii) means defined in said U-shaped upper structure for seating thereon a head protector worn by the user, and (iii) a lower structure, connected to and extending downwardly from a lower portion of said U-shaped upper structure, to overlie the upper thoracic region on opposite sides of the spinal column for dispersing axial compressive forces applied on the head away from the neck and spine to the shoulders and upper thoracic region of the user, said lower structure having an upper portion with an exterior side and an interior side extending in a rearward and downward arcuate direction merging toward said exterior side such that said interior side substantially conforms with the shape of the shoulders and upper thoracic region of the user; and (c) a layer of padding attached to said interior arcuate wall of said upper structure and also attached to and extending down said interior side of said upper portion of said lower structure, said upper and lower structures being composed of a material more rigid than a material composing said layer of padding.

16. The system of claim 15 wherein said lower structure has a lower bifurcated portion defining a pair of legs having spaced inner edges defining a slot extending upwardly therebetween from a lower edge of said lower structure such that said inner edges of said legs are aligned on opposite sides of the spinal column of the user so that said legs overlie the upper thoracic region on opposite sides of the spinal column of the user.

17. The system of claim 16 wherein said pair of legs of said lower bifurcated portion extend away from one another in a divergent rearward and downward fashion.

18. The system of claim 15 wherein said means for seating the head protector is a superior surface defined on said upper structure having an arcuate cross-section and extending about a superior outer edge of said upper structure.

19. The system of claim 17 wherein said inner edges of said legs defining said slot of said lower bifurcated portion extend toward one another in a convergent forward and upward fashion to an arcuate bight disposed closer to said U-shaped upper structure than to said lower edge of said lower structure.

20. The device of claim 4 wherein said means for seating the head protector is a superior surface defined on said upper structure having an arcuate cross-section and extending about a superior outer edge of said upper structure.

* * * * *